United States Patent [19]

Rauch

[11] Patent Number: 4,957,587

[45] Date of Patent: Sep. 18, 1990

[54] APPARATUS FOR PLACING A STRIP OF THERMOPLASTIC MATERIAL AROUND AN OBJECT

[75] Inventor: Manfred Rauch, Sasbach, Fed. Rep. of Germany

[73] Assignee: Fromm Holding AG

[21] Appl. No.: 295,250

[22] PCT Filed: Feb. 11, 1988

[86] PCT No.: PCT/CH88/00034

§ 371 Date: Nov. 30, 1988

§ 102(e) Date: Nov. 30, 1988

[87] PCT Pub. No.: WO88/07473

PCT Pub. Date: Oct. 6, 1988

[30] Foreign Application Priority Data

Mar. 31, 1987 [CH] Switzerland ..... 1227/87

[51] Int. Cl.[5] ..... B65B 13/22; B65B 13/32

[52] U.S. Cl. ..... 156/495; 53/582; 53/592; 100/29; 100/33 PB; 156/579; 156/580

[58] Field of Search ..... 156/468, 495, 579, 580; 100/29, 32, 33 PB; 53/399, 582, 589, 592

[56] References Cited

U.S. PATENT DOCUMENTS

| | | | |
|---|---|---|---|
| 3,586,572 | 6/1971 | Ericsson | 156/359 |
| 3,718,526 | 2/1973 | Annis, Jr. | 156/580 |

FOREIGN PATENT DOCUMENTS

| | | |
|---|---|---|
| 2276221 | 1/1976 | France . |
| 372441 | 9/1963 | Switzerland . |
| 586135 | 2/1977 | Switzerland . |
| 598917 | 11/1977 | Switzerland . |

*Primary Examiner*—Michael Wityshyn

*Attorney, Agent, or Firm*—Toren, McGeady & Associates

[57] ABSTRACT

The apparatus has a strip support (12) which can be advanced in relation to gripping members (14) in order to pre-tension strip sections (6,8) against the clamping members. The clamping members feed, tension and weld the strip sections superimposed on the strip support (12). To improve feeding and tensioning and to avoid damage to the strip parts, the gripping members (14) are fixed to a link conveyor (48) which is guided over two guide wheels and from which at least one clamping member projects at the corresponding strip section (6).

18 Claims, 8 Drawing Sheets

APPARATUS FOR PLACING A STRIP OF THERMOPLASTIC MATERIAL AROUND AN OBJECT

This invention relates to an apparatus for placing a strip of thermoplastic synthetic material about an object, with strip support means to be placed against the object and gripping jaws adapted to be advanced relative to and urged against the strip support means for conveying, tensioning and welding two portions of the strip lying one above the other on the strip support means, working and supporting surfaces of the gripping jaws and strip support means being provided with teeth.

An apparatus of this kind is known, for example, from Swiss Patent 586,135. The apparatus taught by Swiss Patent 586,135 suffers the disadvantage of having a relatively small tensioning fixture which moves in an oscillating motion, so that the advanced strip must be held by an additional clamping member after each forward tensioning stoke of the tensioning fixture to permit the tensioning fixture to move back in a return stroke. This procedure complicates the tensioning process and moreover the strip is heavily stressed as a result of the tensioning fixture contacting the strip over a small area and as a result of the strip being held by the clamping member, thus impairing the strength of the strip and restricting the amount of clamping force which can be used.

Accordingly, it is an object of the present invention to construct an apparatus of the kind in question which will permit optimum prestressing of a plastics strip without undesirable side effects and will enable the strip to be subsequently welded by friction.

The objective is achieved by an apparatus having driven, continuous chain belt means running over two guide wheels and carrying a plurality of gripping jaws so that at least one gripping jaw is at all times engageable with the corresponding portion of the strip.

Owing to the fact that a chain belt equipped with gripping jaws is used, of which at least one gripping jaw is always engaging with a portion of the strip, this makes a large area available for tensioning the strip, and on the other hand, the fact that the chain-belt is always in action during the tensioning process provides continuous tensioning of the strip without stopping it and without clamping it to prevent it from slipping back. The large area of the gripping jaws also allows the strip to be held without being damaged so that the welding process may be carried out without additional clamping systems.

The gripping jaws may, for example, be formed as plates, the outer faces of which are provided with teeth. However, a simpler embodiment is one where the gripping members are one-piece links which extend over the entire width of the chain belt means, which also permits a larger toothed surface. If desired, a plate with teeth may be mounted on such a member and in the event of wear it may be exchanged.

The chain belt may be constructed as a driving chain, at least a single chain and preferably a double chain, where each second link thereof has gripping jaws. A driving chain of this kind may, according to a further embodiment, be a roller or a sleeve chain or, according to yet another embodiment, a toothed-chain.

In order that the chain belt is able to transmit the contact force needed for driving and welding to the strip or strip portions, an embodiment where a run of the chain belt means facing the strip support means runs, on its side remote from the latter, between the guide wheels upon guide means, preferably a slide, is appropriate. Depending on the construction of the chain belt, the guide may be a sliding guide or a roller guide.

There are various possible means of driving the chain belt. Thus, for example, a drive wheel may be provided between the guide wheels. The guide wheels may be either toothed or un-toothed wheels. However, a more advantageous embodiment includes providing at least one of the guide wheels as a sprocket, since here there is no need for an additional drive wheel and one of the guide wheels themselves may act as a drive wheel.

There are various possible ways of driving the drive wheel of the chain belt. However, an embodiment in which a ratchet wheel is secured to a drive shaft for a reversing wheel acting as a drive wheel of the chain belt, and an oscillating rocker is pivotably mounted about the drive shaft, the rocker comprising first and second pawls acting in opposite directions and urged in the direction of the ratchet wheel, the pawl acting against the direction of advance of the strip being associated with a control element for disengaging the first pawl and at the same time, engaging a stationary pawl on the ratchet wheel to act against the direction of advance of the strip, is particularly advantageous, whereby it is readily possible to switch the drive from its function belt transporting means into its function as welding apparatus.

It would be possible to move the chain belt towards the strip support. However, an embodiment wherein the chain belt means and the guide wheels are fixedly connected to a frame of the apparatus, and where the strip support means are adapted to move back and forth by means of a guide device relative to the chain belt means, preferably by a driving device, is more advantageous. The relative movement of the strip support to the chain belt may take place perpendicularly to the plane of the chain belt. However an embodiment in which the guiding device operates obliquely to the strip travel direction and in which the strip support means advances towards the chain belt means at an angle to the plane of the strip, is more advantageous since in this case the movement of the strip support at an angle to the plane of the strip by means of the advance movement intensifies the pressing of the strip support against the chain belt.

The insertion and guiding of the strip sections in the apparatus is made easier by an embodiment having, in the inlet and outlet areas of the intake slot formed between the strip support means and the chain belt means, rear guide arms and front guide arms associated with the insertion side of the strip, the arms pivoting outwards when the strip support is extended and pivoting innards when the strip support is retracted.

Some exemplary embodiments of the apparatus will now be described in more detail with reference to the drawings, wherein.

Figure 1:
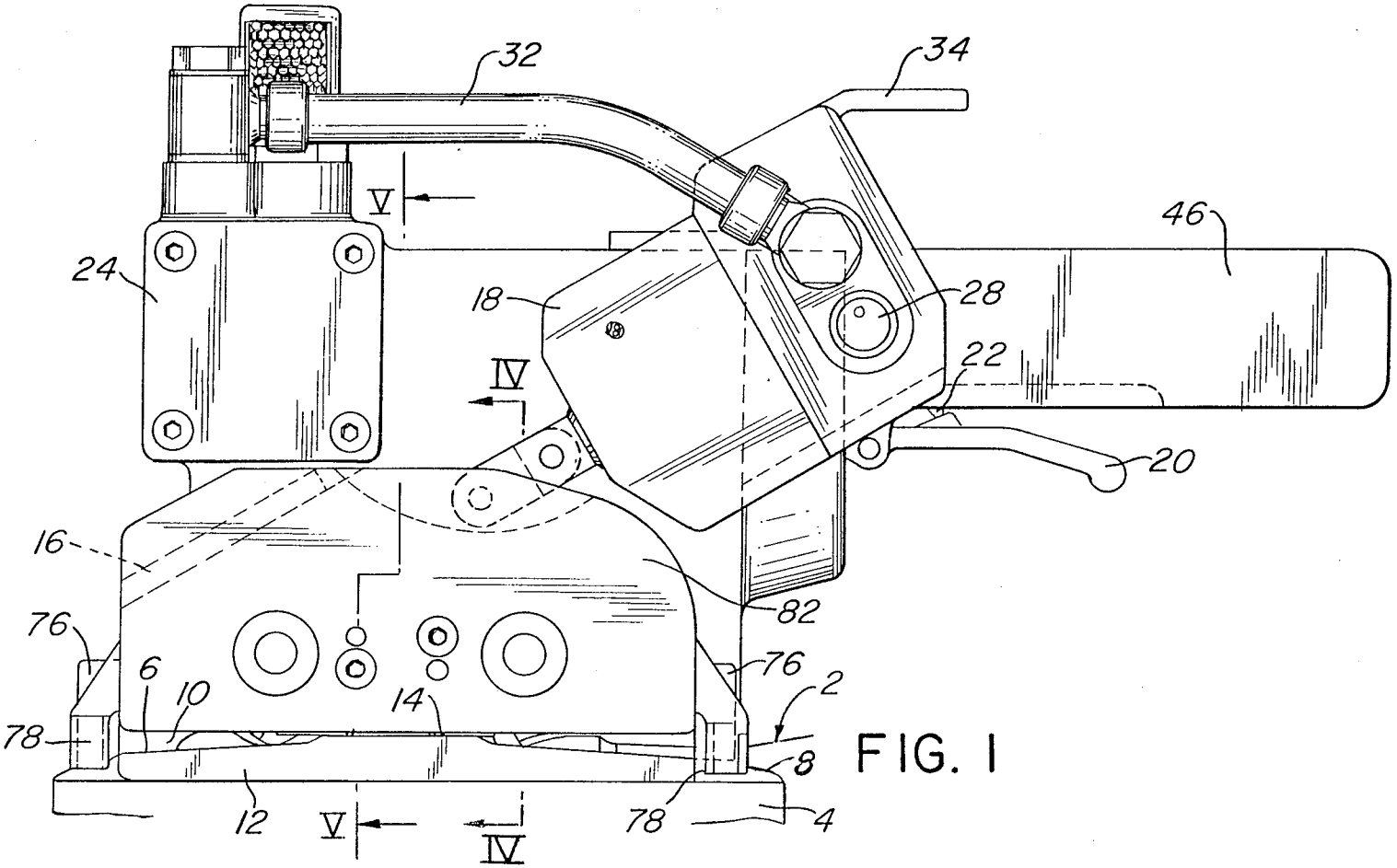
FIG. 1 is an overall elevation view of the apparatus on the side where the strip is inserted.
Figure 2:
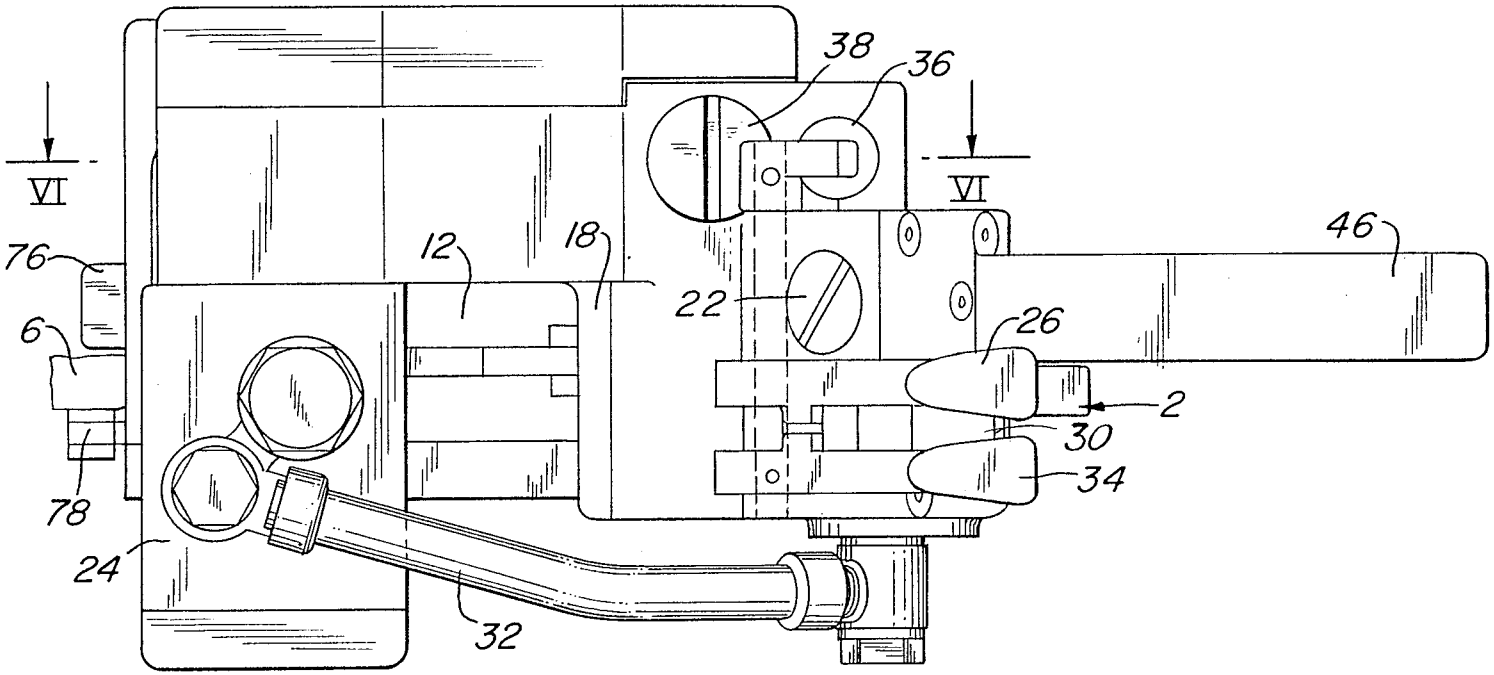
FIG. 2 is a plan view of the apparatus according to FIG. 1.

FIGS. 1 and 2 provide an overall view of an apparatus for placing a strip 2 around an object 4, in which strip portions 6, 8 placed one above the other are arranged and tensioned in intake slot 10 between strip support 12 (which bears against object 4) and gripping members 14.

Figure 6:
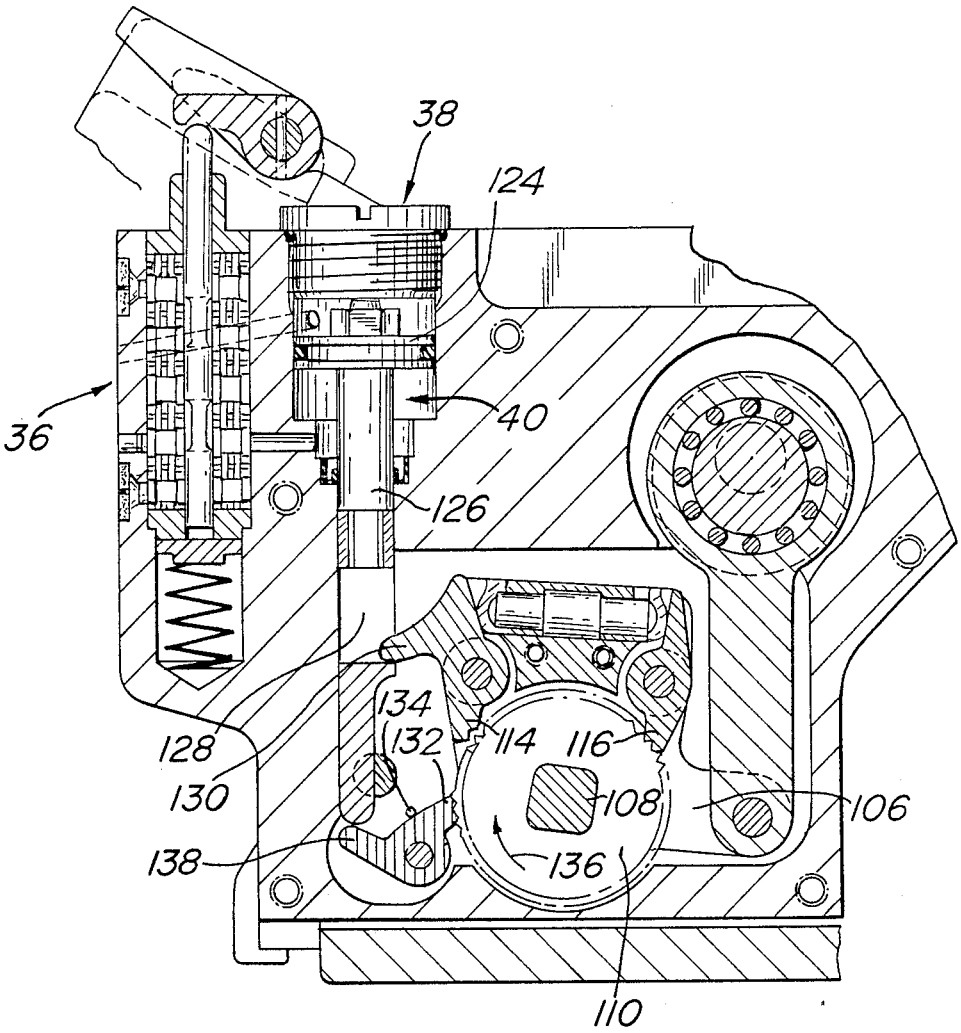
FIG. 6 is a cross-section through the apparatus according to FIG. 2 along the line VI–VI in FIG. 2, showing the strip portions in the process of being tensioned.
Figure 7:
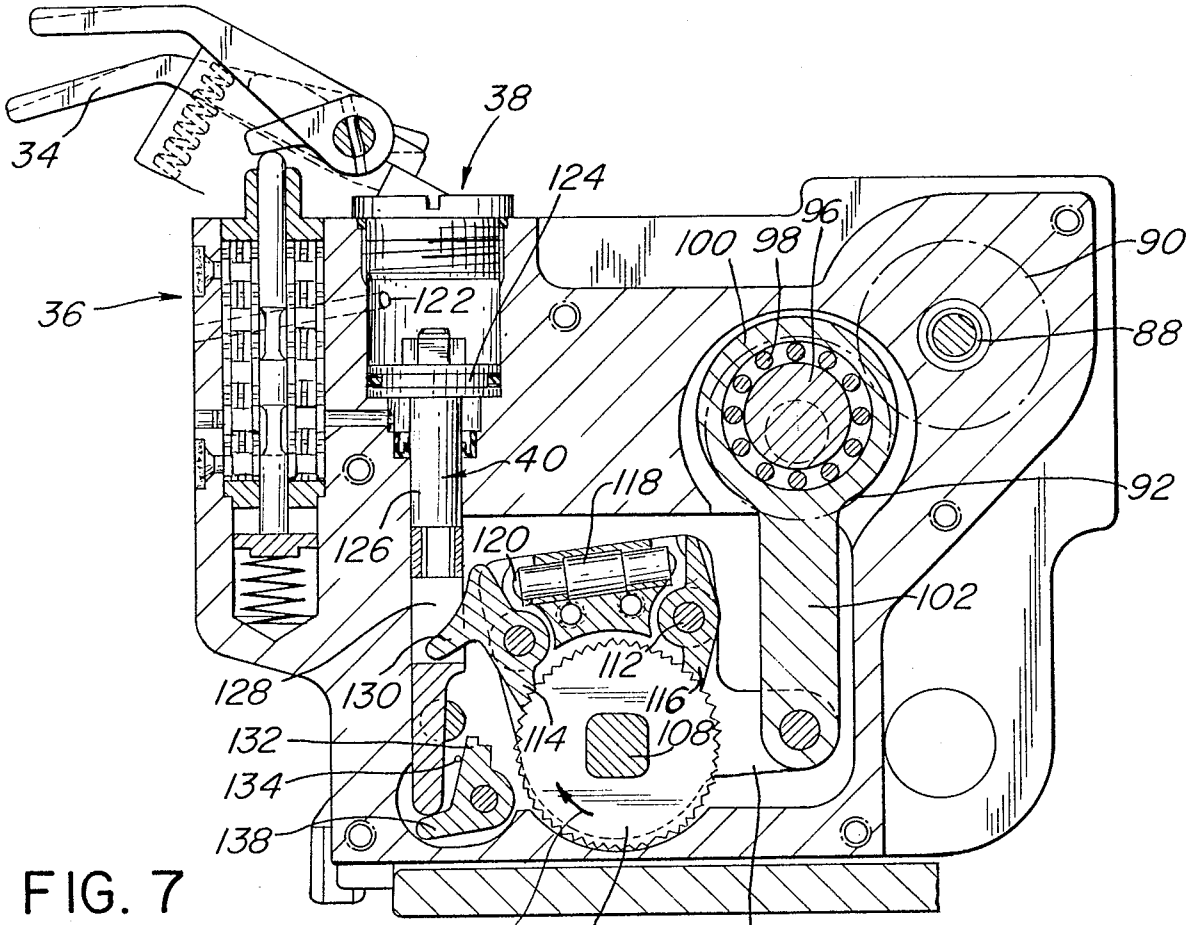
FIG. 7 shows the apparatus according to FIG. 6 in the course of welding the strip portions.

Strip support 12 is adapted to be moved back and forth by means of guiding device 16 and a pneumatic piston/cylinder unit 18 in relation to gripping members 14. Piston/cylinder unit 18 is actuated by hand-lever 20 which acts upon a valve 22 to release compressed air for the said piston/cylinder unit. Alternatively, as is conventional in the art, the gripping members can be moved relative to the strip support. The apparatus contains a pneumatic motor 24 which is used to drive the gripping members 14. This motor may be actuated, on the one hand, by lever 26 which releases the supply of compressed air from main connection 28, through a valve 30 and a feed line 32, to motor 24. The apparatus also contains a lever 34 which also controls motor 24 and also actuates, through a valve 36, the piston/cylinder unit 38 of a control member 40, in order to change over the mechanism 44, between motor 24 and drive shaft 42, from a tensioning mode, as shown in FIG. 6, to a welding mode as seen in FIG. 7, as will be explained hereinafter in detail. Hand-lever 20, and levers 26 and 34, are arranged in such a manner that they can be operated by a handle or grip 46 of the apparatus.

Figure 3:
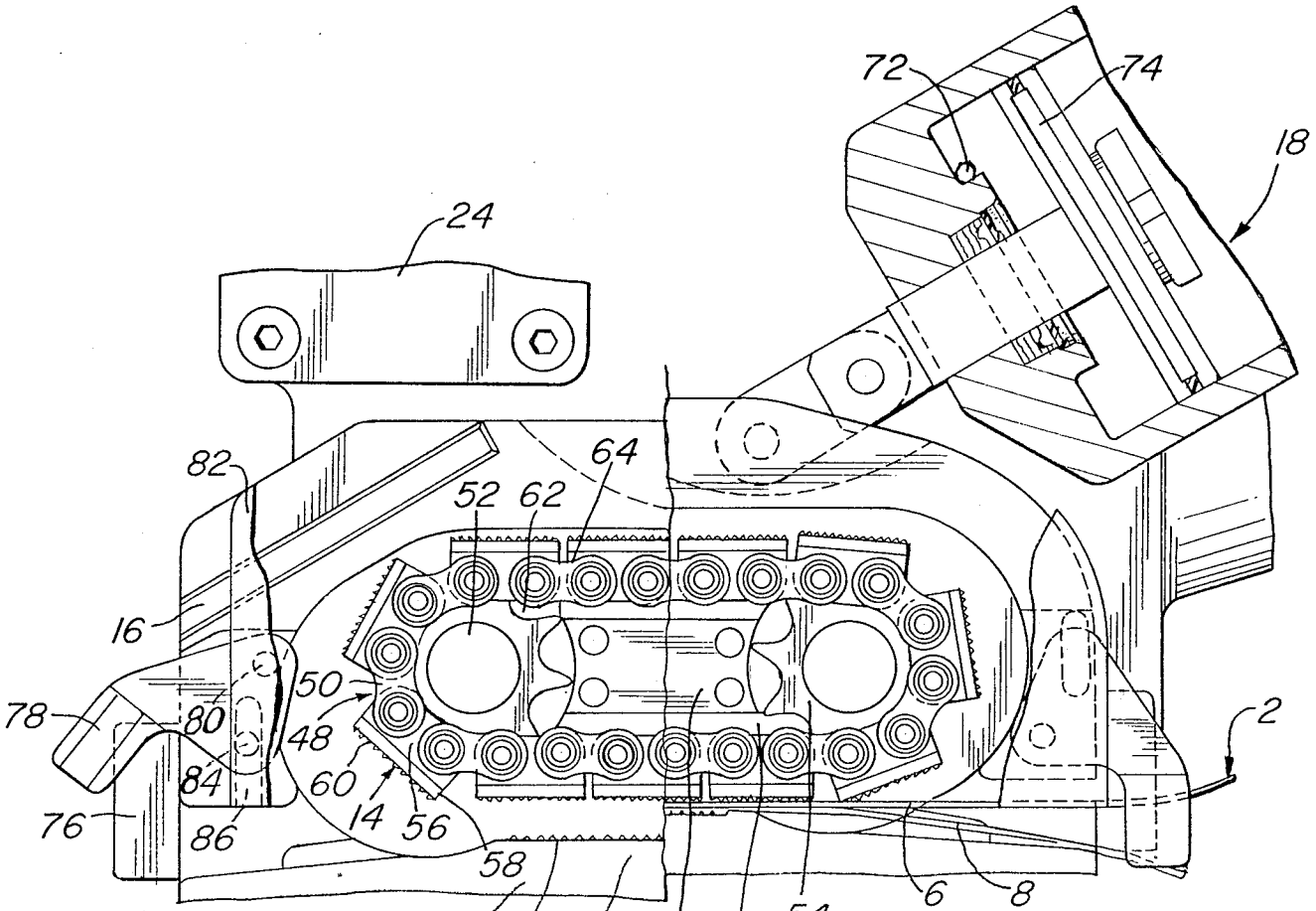
FIG. 3 shows the apparatus according to FIG. 1 in the chain belt area and with the housing-cover broken away, the strip support being extended in the left-hand half in order to tension the parts of the strip.
Figure 4:
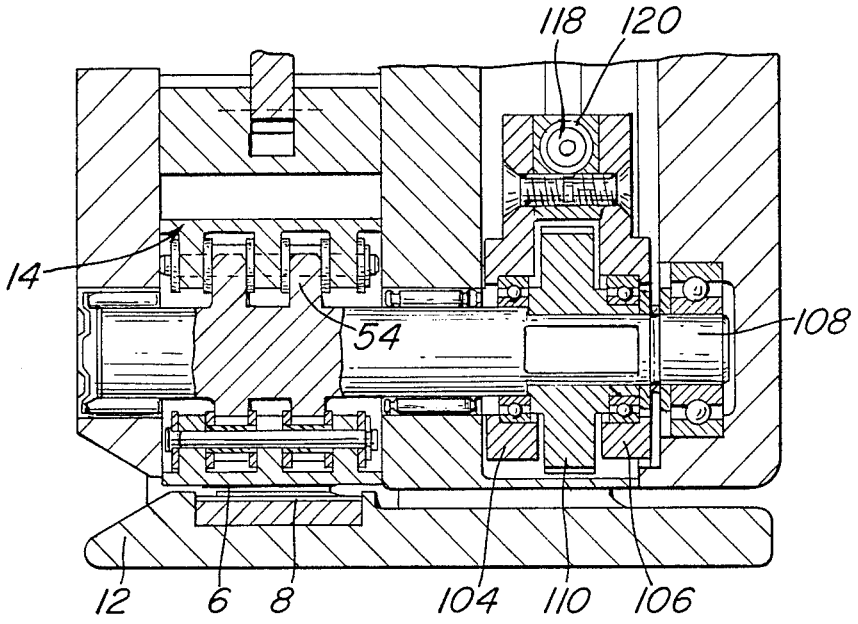
FIG. 4 is a cross-section through the apparatus along the line IV–IV in FIG. 1.
Figure 5:
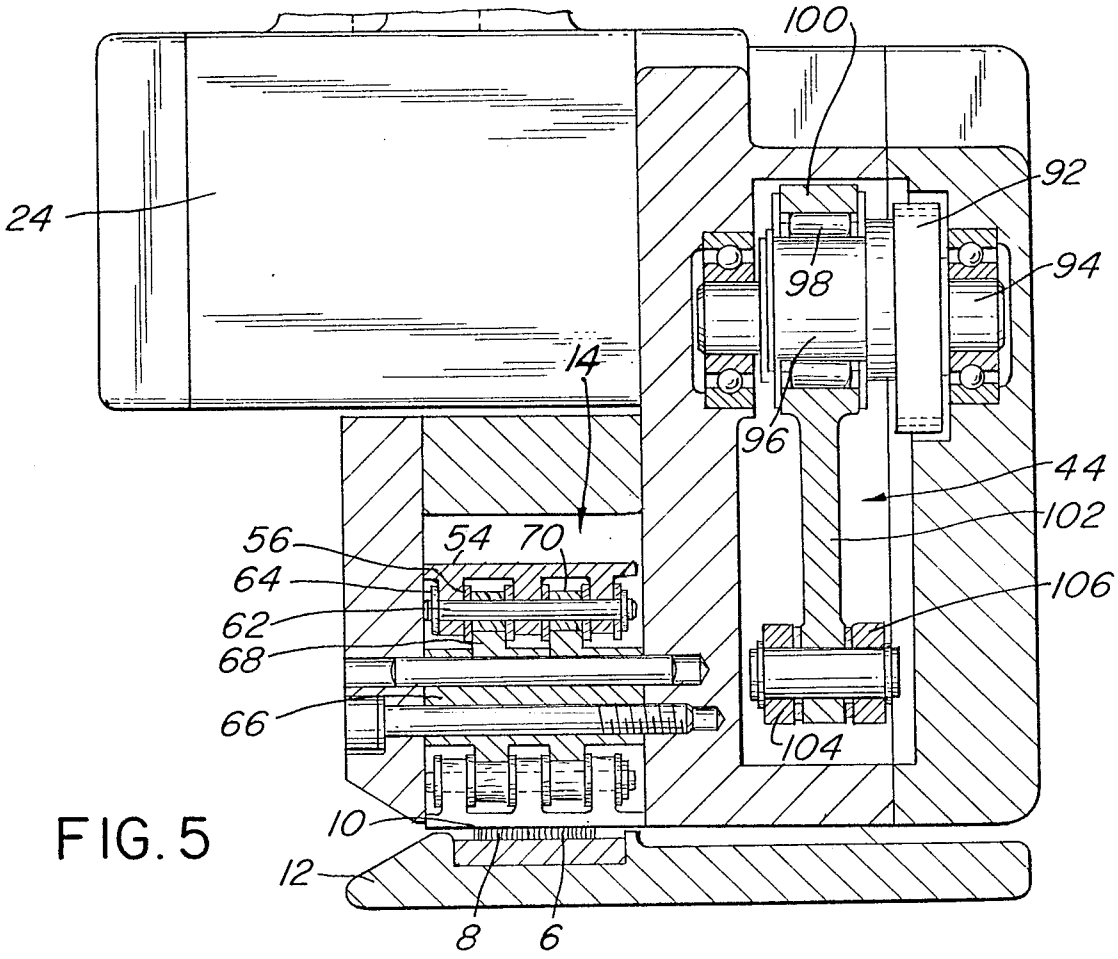
FIG. 5 is a cross-section through the apparatus along the line V–V in FIG. 1.

FIGS. 3 to 5 show in detail the arrangement of clamping members 14 upon chain belt 48 and also the design and actuation of strip support 12. Chain belt 48 consists of a driving chain 50 which is in the form of a double roller-chain. This drive chain 50 runs over two guide wheels 52, 54 in the form of double sprockets. Right-hand guide wheel 54 is the drive-wheel as will be described hereinafter in detail. Every second link of chain 50 comprises a gripping member 14 which extends over the entire width of the chain and whose outside is provided with a replaceable plate 58 carrying teeth 60. The teeth may also be formed directly on link 56 without an additional plate. Pins 62 connect link 56 with intermediate members 64. Arranged between guide wheels 52, 54 is a sliding guide block 66 comprising guide rails 68 for the rollers 70 of the drive chain 50.

FIG. 3 shows more clearly the strip support 12 provided with teeth 71. Strip support 12 is guided by guiding means 16 in the direction of movement of the strip and at an angle to the plane of the strip support 12 and the strip. Strip support 12 is adapted to be moved, by means of piston/cylinder unit 18, towards gripping members 14 of drive chain 50. The position shown in the right-hand half of FIG. 3 is a basic position in which compressed air passes, through supply line 72, to the rear of piston 74, thus pressing strip support 12 against gripping members 14. The inclined guiding device 16 supports this pressure since, during tensioning, the strip is moved to the right and thus reinforces the pressue applied by piston/cylinder unit 18.

The left-hand half of FIG. 3 shows strip support 12 released from gripping members 14, so that intake slot 10 is free to accept strip portions 6,8 In this position, it is also possible to recognize rear guide arms 76 against which strip portions 6,8 may be brought to bear upon insertion into intake slot 10. When strip support 12 is extended, front guide arms 78 are swung upwardly, as may by seen on the left-hand side of FIG. 3. The said guide arms are mounted pivotably upon pins 80 in front housing-plate 82 and engage, by means of a stud 84, in a guide slot 86 associated with strip support 12.

Mechanism 44, for driving chain belt 48 by means of motor 24, may be seen more clearly in FIGS. 4 to 7. Through shaft 88, the said motor drives gearwheel 90 which meshes with gearwheel 92 of an eccentric shaft 94. Mounted upon eccentric 96 of shaft 94, by means of a ball-bearing 98, is race 100 of connecting rod 102. This drives rockers 104, 106 which are mounted pivotably upon drive shaft 108 on each side of a ratchet wheel 110 connected to the said drive shaft. The drive shaft 108 carries driven guide wheel 54. Mounted pivotably, on pins 112 between rockers 104, 106, are pawls 114, 116 which, by means of a spring 118 and tappets 120, engage, urged in opposite directions, with ratchet wheel 110, as may be appreciated more particularly from FIG. 7. This configuration is reached when valve 36 is actuated by actuating lever 34 so that the upper side of piston 124 of piston/cylinder unit 38 of control member 40 is acted upon through line 122.

By means of control recess 128, piston rod 126 is disengaged from arm 130 of pawl 114. Pawl 114 therefore remains in engagement with ratchet wheel 110 under the action of spring 118. At the same time, piston rod 126 actuates a pawl 132 which is normally engaged with ratchet wheel 110, against the direction of advance, under the action of a biasing spring. In this connection, piston rod 126 co-operates with an arm 138 of pawl 132 against the action of biasing spring 134.

FIG. 6 shows the basic arrangement of the mechanism which holds valve 36 in the basic position, so that the underside of piston 124 is acted upon, through feed line 140, by compressed air and thus assumes the upper basic setting. This causes control recess 128 in piston rod 126 to co-operate with are 130 of pawl 114 and pawl 114 is therefore disengaged from ratchet wheel 110. At the same time, pawl 132 is released and thus engages, under the action of spring 134, with ratchet wheel 110, against the direction of advance 136 of the ratchet wheel 110. This enables pawl 116 to advance by a certain amount at each oscillating movement of ratchet wheel 110. Pawl 132 prevents the said ratchet wheel from turning backwards.

Figure 8:
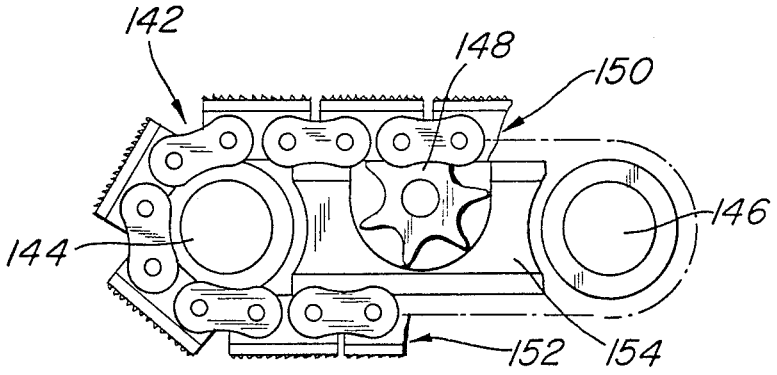
FIG. 8 shows the arrangement for the chain belt of FIG. 3 with an additional drive-wheel.

FIG. 8 shows an alternative arrangement of another chain belt 142 which is also in the form of a driving chain, for example, and runs over guide wheels 144, 146. The latter need not have teeth because an additional driving gearwheel 148 is provided which engages, between the said guide wheels, with upper run 150 of the chain belt. The inside of lower run 152 bears upon a sliding guide block 154.

Figure 9:
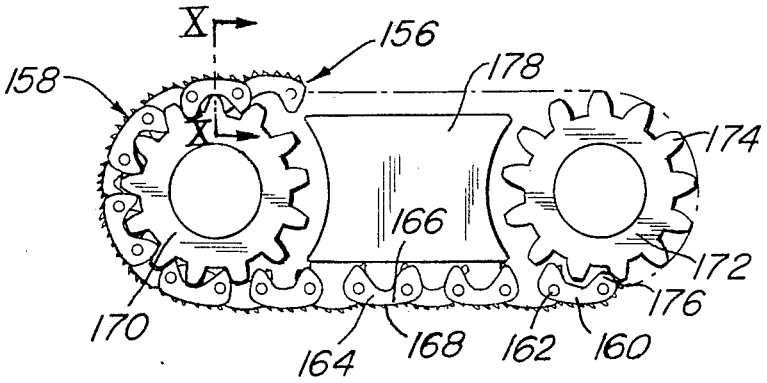
FIG. 9 shows a further embodiment of a chain belt as a toothed chain in view similar to FIG. 3.
Figure 10:
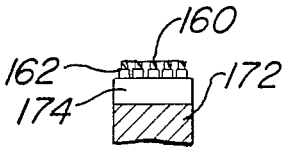
FIG. 10 is a view of the chain belt in the direction X–X in FIG. 9.

FIGS. 9 and 10 show another embodiment of the chain belt 156 which is in the form of a toothed chain 158. The latter consists of a series of thin plates 160 arranged between individual pins 162 in links 164 of the chain. Plates 160 are staggered from link to link. Outer surfaces 166 of plates 160 carry teeth 168. The chain belt runs over guide wheels 170, 172, one of which is driven. The guide wheels carry teeth 174 which co-operate with teeth 176 of chain 158. Sliding guide block 178 is provided between guide wheels 170, 172.

Many additional embodiments are possible; in particular, instead of the pneumatic drive and pneumatic control, an eletrical drive and electromagnet may be provided as control means.

LIST OF REFERENCE NUMERALS

2. Strip
4. Object
6. Strip section
8. Strip section
10. Intake slot
12. Strip support
14. Gripping member
16. Guide means of 12
18. Piston/cylindar unit
20. Hand lever
22. Valve
24. Motor for 14
26. Lever (tensioning)
28. Main connection
30. Valve
32. Line
34. Lever (welding)
36. Valve
38. Piston/cylindar unit
40. Control means
42. Drive shaft
44. Mechanism
46. Handle
48. Chain belt
50. Driving chain
52. Guide wheel
54. Guide wheel
56. Member
58. Plate
60. Tooth
62. Pin
64. Intermediate member
66. Guiding block
68. Guide rail
70. Roller
71. Tooth of 12
72. Line
74. Piston
76. Fixed guide arm
78. Pivotable guide arm
80. Pin
82. Front housing plate
84. Pin
86. Guide slot
88. Motor shaft
90. Gear wheel
92. Gear wheel
94. Eccentric shaft
96. Eccentric
98. Ball bearing
100. Race
102. Connecting rod
104. Rocker
106. Rocker
108. Drive shaft
110. Ratchet wheel
112. Pin
114. Pawl
116. Pawl
118. Spring
120. Push rod
122. Line
124. Piston
126. Piston Rod
128. Control Recess
130. Arm
132. Pawl
134. Biasing Spring
136. Direction of advance
138. Arm
140. Line
142. Chain belt
144. Guide wheel
146. Guide wheel
148. Drive gear wheel
150. Upper run
152. Lower run
154. Guide block
156. Chain belt
158. Tooth chain
160. Thin plate
162. Pin
164. Member
166. Face
168. Tooth
170. Guide wheel
172. Guide wheel
174. Teeth
176. Tooth
178. Guiding block

I claim:

1. An apparatus for placing a strip of thermoplastic synthetic material about an object, with strip support means (12) to be placed against the object (4) and gripping jaws (14), at least one of the strip support means and the gripping jaws being advanceable relative to and urgeable toward the other of the strip support means and the gripping jaws for conveying, tensioning and welding two portions (6, 8) of the strip lying one above the other on the strip support means (12), working and supporting surfaces of the gripping jaws and strip means being provided with teeth, characterized in that said apparatus comprises driven, continuous chain belt means (48, 142, 156) running over two guide wheels (52, 54, 144, 146, 170, 172) and carrying a plurality of gripping jaws (14) so that at least one gripping jaw (14) is at all times engageable with a corresponding portion of the strip (6).

2. An apparatus according to claim 1, wherein the gripping jaws (14) are in the form of plates (160) forming links are arranged to be offset from link (164) to link (164) parallel to a plane of travel of the chain belt means, and staggered in relation to each other, with outer faces (166) of the plates being provided with teeth (168).

3. An apparatus according to claim 1, wherein the gripping jaws (14) are in the form of one-piece links (56) of the chain belt means extending over the entire width of the chain belt means (48).

4. An apparatus according to claim 1, wherein the chain belt means (48, 142, 156) is a driving chain (50), each second link (56) thereof comprising gripping jaws (14).

5. An apparatus according to claim 4, wherein the driving chain (50, 142) is one of a roller-chain and a sleeve chain.

6. An apparatus according to claim 4, wherein the driving chain is in the form of a tooth-chain (158).

7. An apparatus according to claim 4, wherein the driving chain is at least a single chain.

8. An apparatus according to claim 7, wherein the driving chain is a double chain.

9. An apparatus according to claim 1, wherein a run (152) of the chain belt means (48, 142, 156) facing the strip support means (12) runs, on its side remote from the latter, between the guide wheels (52, 54, 144, 146, 170, 172) upon guide means (66, 154, 178).

10. An apparatus according to claim 9, wherein the guide means is a slide.

11. An apparatus according to claim 1, wherein drive wheel means (148) are arranged between the guide wheels (144, 146).

12. An apparatus according to claim 1, wherein at least one of the guide wheels (54, 172) is in the form of a sprocket.

13. An apparatus according to claim 12, wherein the sprocket is a driven sprocket.

14. An apparatus according to claim 1, wherein a ratchet wheel (110) is secured to a drive shaft (108) for a reversing wheel acting as a drive wheel (54) of the chain belt (48), and an oscillating rocker (104, 106) is pivotably mounted about said drive shaft (108), said rocker (104, 106) comprising first and second pawls (114, 116) acting in opposite directions and urged in the direction of the ratchet wheel (110), the pawl (114) acting against a direction of advance (136) of the strip (2) being associated with a control element (40) for disengaging the first pawl (114) and at the same time, engaging a stationary pawl (132) on the ratchet wheel (110) to act against the direction of advance (136) of the strip (2).

15. An apparatus according to claim 1, and further comprising an apparatus frame, the chain belt means (48, 142, 156) and the guide wheels (52, 54, 144, 146, 170, 172) being fixedly connected to said frame, the strip support means (12) being adapted to move back and forth by means of a guide device (16) relative to the chain belt means.

16. An apparatus according to claim 15, wherein the guiding device (16) operates obliquely to the strip travel direction and the strip support means (12) advances towards the chain belt means (48, 142, 156) at an angle to the plane of the strip (2).

17. An apparatus according to claim 15, and further comprising, in the inlet and outlet areas of an intake slot (10) formed between the strip support means (12) and the chain belt means (48, 142, 156), rear guide arms (76) and front guide means (78) associated with an insertion side of the strip, said arms pivoting outwards when the strip support means (12) is extended and pivoting inwards when the strip support means is retracted.

18. An apparatus according to claim 15, wherein the guide device is a driving device (18).

* * * * *